US011019429B1

(12) United States Patent
Hui

(10) Patent No.: US 11,019,429 B1
(45) Date of Patent: May 25, 2021

(54) WEARABLE STEREOPHONIC DEVICE

(71) Applicant: Lok Hin Hui, Hong Kong (CN)

(72) Inventor: Lok Hin Hui, Hong Kong (CN)

( * ) Notice: Subject to any disclaimer, the term of this patent is extended or adjusted under 35 U.S.C. 154(b) by 509 days.

(21) Appl. No.: 16/064,471

(22) PCT Filed: Mar. 2, 2018

(86) PCT No.: PCT/CN2018/077855
§ 371 (c)(1),
(2) Date: Jun. 21, 2018

(87) PCT Pub. No.: WO2018/157855
PCT Pub. Date: Sep. 7, 2018

(30) Foreign Application Priority Data

Mar. 3, 2017 (HK) ..... 17102290.4

(51) Int. Cl.
*H04R 5/02* (2006.01)
*H04R 5/033* (2006.01)
*H04R 1/10* (2006.01)

(52) U.S. Cl.
CPC ..... *H04R 5/02* (2013.01); *H04R 1/1083* (2013.01); *H04R 5/0335* (2013.01); *H04R 2201/10* (2013.01)

(58) Field of Classification Search
CPC ..... H04R 5/02; H04R 1/1083; H04R 5/0335; H04R 2201/10
See application file for complete search history.

(56) References Cited

U.S. PATENT DOCUMENTS 4,754,901 A * 7/1988 Villanueva ..... H04R 1/026 224/418
2014/0254855 A9* 9/2014 Yamaguchi ..... H04R 1/1058 381/378
2017/0347192 A1* 11/2017 Seo ..... H04R 5/04

* cited by examiner

*Primary Examiner* — Andrew L Sniezek

(57) ABSTRACT

The present application relates to the field of stereophonic devices and discloses a wearable stereophonic device comprising a right shell, a center shell and a left shell, wherein two sides of the center shell are connected to the right shell and the left shell via adjustment slide strips (3), respectively. In the present invention, 5.0 surround sound is supported; a massage function can be provided while enjoying music; the interferences from external noise is reduced by open-ear active noise cancelling control; and, the wearable stereophonic device can be cooperatively connected and used with other advanced application technologies such as Virtual Reality (VR), Augmented Reality (AR) and Mixed Reality (MR), and compatible to other applications and devices such as electronic sports, smart motorbikes or smart bikes.

6 Claims, 5 Drawing Sheets

WEARABLE STEREOPHONIC DEVICE

FIELD OF THE INVENTION

The embodiments of the present application relate to the field of stereophonic devices, and in particular to a wearable stereophonic device.

BACKGROUND OF THE INVENTION

The designed device of the wearable surround sound stereo system is to turn the form of traditional way of the surround sound enjoyment from a fixed and roomy place with all the corresponding technically matched audio hardware system be placed into a high mobility and high quality wearable surround sound stereo system with open-ear active noise cancelling system and vibration control system. Users enjoy the high-quality audio and video entertainment without having to sit in a fixed and pre-set position as they do in a conventional indoor surround sound stereo systems since in conventional system, a satisfying enjoyment effect cannot be achieved if the volume is not large enough while a high volume on the other hand causes inconvenience for the neighborhood and people surrounding. There are wearable personal sound devices like earphones and others; however, such wearable personal sound devices and earphones in the existing art at least have the following technical problems:

1. dissatisfaction of the requirement on the high-quality sound effect, 5.0 or even 4.0 surround sound system in particular,
2. the speaker function and the call function have great influence on the surrounding environment and persons,
3. high energy consumption, short playback time; and
4. non-obvious perception and experience of the audio field.

SUMMARY OF THE INVENTION

The objective of the embodiments of the present application is to provide a wearable stereophonic device for solving the technical problems in the prior art such as the failure of providing high quality sound effect by a wearable personal sound device, an earphone of the like kind, the huge interfering on the surrounding environment and persons, high energy consumption, short playback time, and inobvious perception and experience of the audio field.

The objective of the present application is realized by the following technical solutions.

A wearable stereophonic device is provided, including a right shell, a center shell and a left shell, wherein two sides of the center shell are connected to the right shell and the left shell via adjustment slide strips 3, respectively;

the center shell includes an adjustment position surface shell 1, an adjustment position bottom shell 2 and a center loudspeaker 8;

the right shell includes a front right surface shell 4, a front right bottom shell 5, a right loudspeaker 9 and a first PCB board 16;

the left shell includes a front left surface shell 6, a front left bottom shell 7, a left loudspeaker 10, a second PCB board 27 and a lithium battery 26; and the first PCB board 16 is arranged between the front right surface shell 4 and the front right bottom shell 5, and an earphone jack 19, a wireless communication chip 20 and a charge interface 24 are provided on the first PCB board 16.

In some embodiments, the center loudspeaker 8 consists of a center speaker grille and a center speaker 13; a center vibration motor 14 and the center speaker 13 are arranged between the adjustment position surface shell 1 and the adjustment position bottom shell 2; the adjustment slide strips 3 are arranged on left and right sides of the center shell; and movable sliders 15 are provided at ends of the adjustment slide strips 3;

a right control bottom 11 and an LED lamp and lampshade 25 are provided on the front right surface shell 4; the right loudspeaker 9 consists of a right center speaker 17, a front right speaker 22 and a front right speaker vibration diaphragm 21; the front right speaker vibration diaphragm 21 is attached onto a surface of the front right speaker 22; a right center vibration motor 18 is provided besides the right center speaker 17; and a front right vibration motor 23 is provided besides the front right speaker 22; and the lithium battery 26 and the second PCB board 27 are arranged between the front left surface shell 6 and the front left bottom shell 7; a microphone 28, an audio decoding chip 34 and a microprocessor 35 are provided on the second PCB board 27; a left control button 12 is provided on the front left surface shell 6; the left loudspeaker 10 consists of a left center speaker 30, a front left speaker 32 and a front left speaker vibration diaphragm 33; the front left speaker vibration diaphragm 33 is attached onto a surface of the front left speaker 32; a front left vibration motor 31 is provided besides the front left speaker 32; and a left center vibration motor 29 is provided besides the left center speaker 30.

In some embodiments, the audio decoding chip 34 is connected to the center speaker 13, the right center speaker 17, the earphone jack 19, the front right speaker 22, the left center speaker 30, the front left speaker 32 and the microprocessor 35, respectively; and, the microprocessor 35 is connected to the right control bottom 11, the left control button 12, the center vibration motor 14, the right center vibration motor 18, the wireless communication chip 20, the front right vibration motor 23, the microphone 28, the left center vibration motor 29 and the front left vibration motor 31, respectively.

In some embodiments, the microphone 28 is used for receiving external noise; the microprocessor 35 is used for generating reversed-phase noise which is opposite in phase to the external noise, and superposing the reversed-phase noise into the outputs from the center loudspeaker 8, the right loudspeaker 9 and the left loudspeaker 10.

In some embodiments, the microphone 28 has a front low-pass filter which has a cutoff frequency of 200 Hz and is used for filtering sound at a frequency of above 200 Hz.

In some embodiments, the wireless communication chip 20 can be one or more of a Bluetooth chip, a Near Field Communication (NFC) chip, a Wi-Fi chip and an infrared chip.

The present application provides a wearable stereophonic device, which supports that basic sound channels of the digital sound stereo system are independently connected to different speakers, i.e., a front right speaker, a center speaker, a front left speaker, a rear right speaker and a rear left speaker, and also supports output by a single sound channel and stereo output. By cooperating with an audio decoding chip 34 that fully supports digital surround standards such as Dolby Digital and Digital Theater System (DTS), a high-performance Micro-Controller digital surround audio decoder for compounding and processing signals is realized, and the high-quality sound effect experience of the wearable personal sound products is satisfied; moreover, due to the open noise, vibration control, power control and structural optimization, a user is able to enjoy the high-quality of sound while in prevent causing any unnecessary interferences to the surrounding environment and persons and the user can still be aware of the conditions of the surrounding environment so that the probability of accidents is reduced. In the present application, by additionally providing mini vibration motors (a center vibration motor 14, a right center vibration motor 18, a front right vibration motor 23, a left center vibration motor 29 and a front left vibration motor 31), the user can experience the high-quality sound effect and also enjoy the massage experience, particularly the massage to the shoulders, the neck, and the surrounding muscles and acupuncture points. In the present application, by additionally providing telescopic structures (adjustment slide strips 3) and guide structures for the placement positions, angles and sound channel ports of the speakers (a center speaker 13, a right center speaker 17, a front right speaker 22, a left speaker 30 and a front left speaker 32), the individual requirements are satisfied; and different sound effect compensation circuits are designed additionally by the audio balancer. The present application can provide various alternative application methods: playing by a loudspeaker, playing by an earphone, access to AUX, NFC (Near Field Communication) transmission, Bluetooth transmission, Wi-Fi transmission or infrared transmission. The wearable stereophonic device can be cooperatively connected and used with other advanced application technologies such as Virtual Reality (VR), Augmented Reality (AR) and Mixed Reality (MR), and compatible to other applications and devices such as electronic sports, smart motorbikes or smart bikes, while backward compatible with the previous audio/video connection modes such as Auxiliary Input (AUX In).

BRIEF DESCRIPTION OF THE DRAWINGS

In order to describe the technical solutions in the embodiments of the present application or in the prior art more clearly, the drawings in the description of the embodiments to be used will be briefly described below. Apparently, the drawings described hereinafter are some of the embodiments of the present application, and a person of ordinary skill in the art can obtain other drawings according to these drawings without paying any creative effort.

FIG. 5 is a schematic diagram of a circuit connection structure according to an embodiment of the present application, in which:

1: adjustment position surface shell; 2: adjustment position bottom shell; 3: adjustment slide strip; 4: front right surface shell; 5: front right bottom shell; 6: front left surface shell; 7: front left bottom shell; 8; center loudspeaker; 9: right loudspeaker; 10: left loudspeaker; 11: right control bottom; 12: left control button; 13; center speaker; 14: center vibration motor; 15; movable slider; 16: first PCB board; 17: right center speaker; 18: right center vibration motor; 19: earphone jack; 20: wireless communication chip; 21: front right speaker vibration diaphragm; 22: front right speaker; 23: front right vibration motor; 24: charge interface; 25: LED lamp and lampshade; 26: lithium battery; 27: second PCB board; 28: microphone; 29: left center vibration motor; 30: left center speaker; 31: front left vibration motor; 32: front left speaker; 33: front left speaker vibration diaphragm; 34: audio decoding chip; and 35: microprocessor.

DETAILED DESCRIPTION OF THE PRESENT INVENTION

To make the objectives, features and advantages of the present application more obvious and comprehensible, the present application will be further described below in detail by specific implementations with reference to the accompanying drawings.

Figure 1:
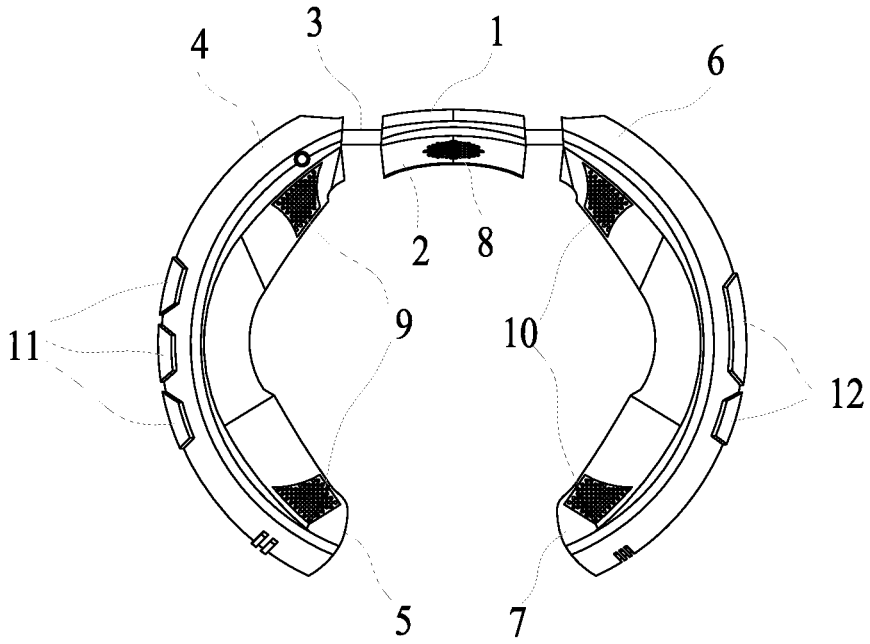
FIG. 1 is a structural diagram of an embodiment of the present application.
Figure 2:
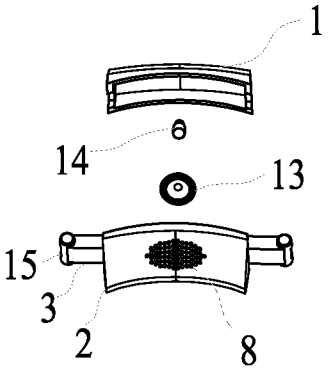
FIG. 2 is a structural diagram of a center loudspeaker portion according to an embodiment of the present application.
Figure 3:
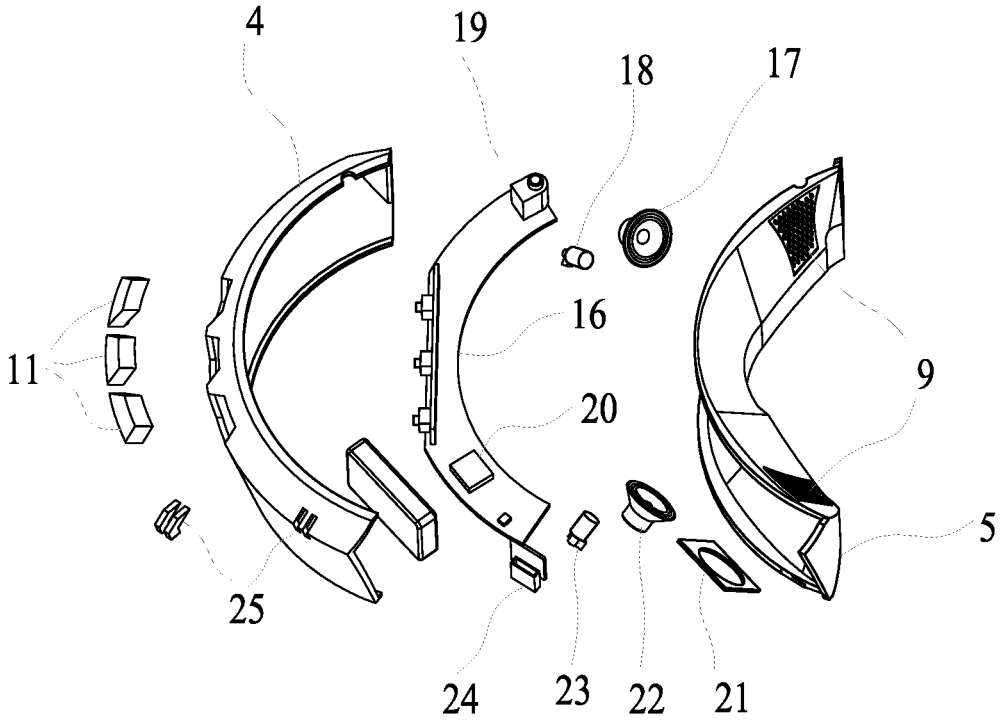
FIG. 3 is a structural diagram of a right loudspeaker portion according to an embodiment of the present application.
Figure 4:
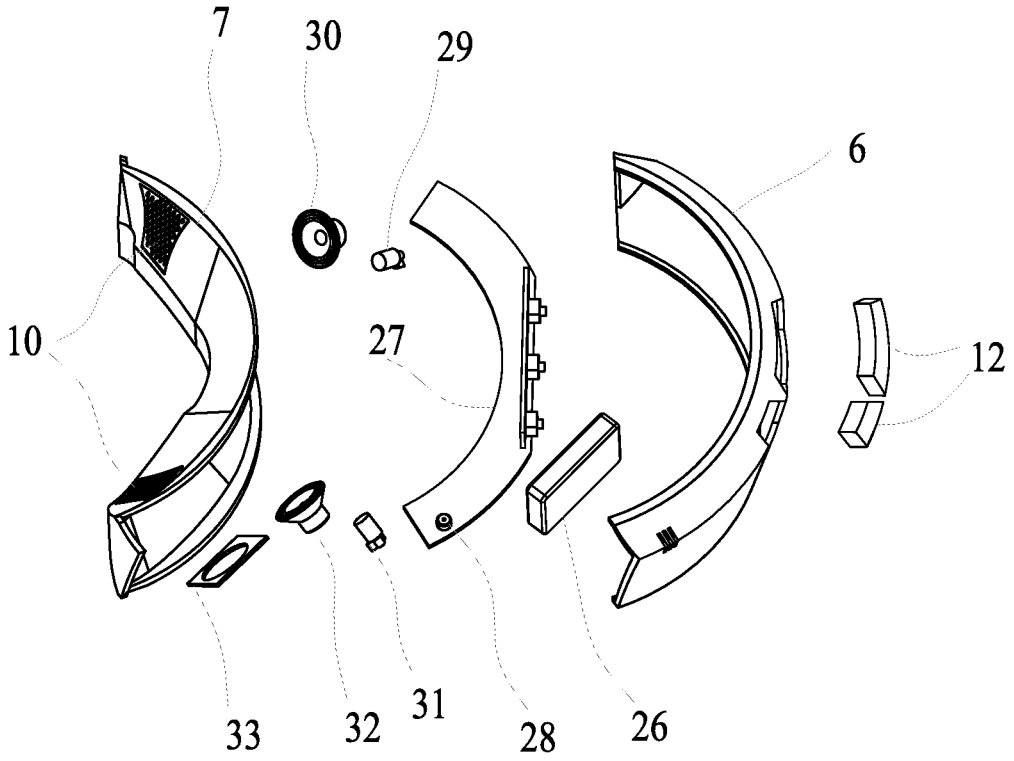
FIG. 4 is a structural diagram of a left loudspeaker portion according to an embodiment of the present application.
Figure 5:
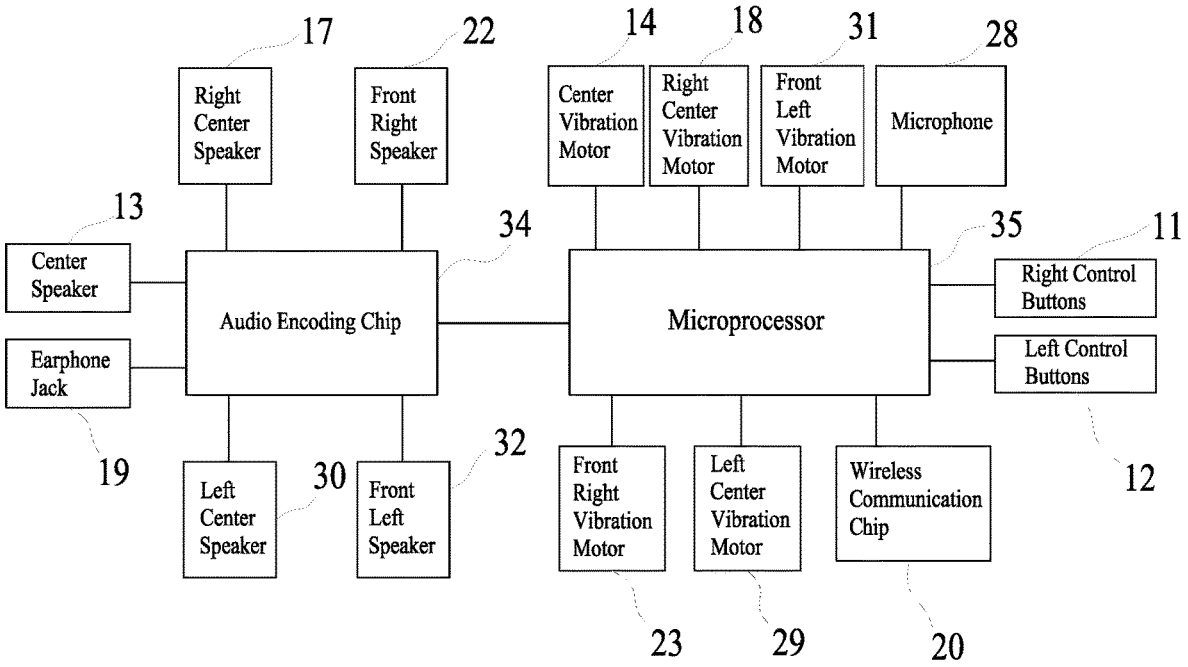

As shown in FIGS. 1-5, a wearable stereophonic device is provided, including a right shell, a center shell and a left shell, wherein two sides of the center shell are connected to the right shell and the left shell via adjustment slide strips 3, respectively.

The center shell includes an adjustment position surface shell 1, an adjustment position bottom shell 2 and a center loudspeaker 8. The center loudspeaker 8 consists of a center speaker grille and a center speaker 13. A center vibration motor 14 and the center speaker 13 are arranged between the adjustment position surface shell 1 and the adjustment position bottom shell 2. The adjustment slide strips 3 are arranged on left and right sides of the center shell, and movable sliders 15 are provided at ends of the adjustment slide strips 3.

The right shell includes a front right surface shell 4, a front right bottom shell 5, a right loudspeaker 9 and a first PCB board 16. The first PCB board 16 is arranged between the front right surface shell 4 and the front right bottom shell 5. An earphone jack 19, a wireless communication chip 20 and a charge interface 24 are provided on the first PCB board 16. A right control bottom 11 and an LED lamp and lampshade 25 are provided on the front right surface shell 4. The right loudspeaker 9 consists of a right center speaker 17, a front right speaker 22 and a front right speaker vibration diaphragm 21. The front right speaker vibration diaphragm 21 is attached onto a surface of the front right speaker 22. A right center vibration motor 18 is provided besides the right center speaker 17, and a front right vibration motor 23 is provided besides the front right speaker 22.

The left shell includes a front left surface shell 6, a front left bottom shell 7, a left loudspeaker 10, a second PCB board 27 and a lithium battery 26. The lithium battery 26 and the second PCB board 27 are arranged between the front left surface shell 6 and the front left bottom shell 7. A microphone 28, an audio decoding chip 34 and a microprocessor 35 are provided on the second PCB board 27. A left control button 12 is provided on the front left surface shell 6. The left loudspeaker 10 consists of a left center speaker 30, a front left speaker 32 and a front left speaker vibration diaphragm 33. The front left speaker vibration diaphragm 33 is attached onto a surface of the front left speaker 32. A front left vibration motor 31 is provided besides the front left speaker 32, and a left center vibration motor 29 is provided besides the left center speaker 30.

The audio decoding chip 34 is connected to the center speaker 13, the right center speaker 17, the earphone jack 19, the front right speaker 22, the left center speaker 30, the front left speaker 32 and the microprocessor 35, respectively. The microprocessor 35 is connected to the right control bottom 11, the left control button 12, the center vibration motor 14, the right center vibration motor 18, the wireless communication chip 20, the front right vibration motor 23, the microphone 28, the left center vibration motor 29 and the front left vibration motor 31, respectively. The wireless communication chip 20 can be one or more of a Bluetooth chip, a Near Field Communication (NFC) chip, a Wi-Fi chip and an infrared chip. For example, the wireless communication chip 20 can be a combination of a Bluetooth chip and an NFC chip to support Bluetooth and NFC functions, or a combination of a Bluetooth chip and a Wi-Fi chip to support Bluetooth and Wi-Fi functions, or a combination of an NFC chip and a Wi-Fi chip to support NFC and Wi-Fi functions, or a combination of a Bluetooth chip, an NFC chip and a Wi-Fi chip to support Bluetooth, NFC and Wi-Fi functions; and, each combination can also support an infrared function.

In order to realize the open-ear active noise cancelling control, the microphone 28 is used for receiving external noise; and, the microprocessor 35 is used for generating reversed-phase noise which is opposite in phase to the external noise, and superposing the reversed-phase noise into outputs from the center loudspeaker 8, the right loudspeaker 9 and the left loudspeaker 10.

The microphone 28 has a front low-pass filter which has a cutoff frequency of 200 Hz and is used for filtering sound at a frequency of above 200 Hz. In this way, only the low-frequency noise is eliminated by the noise reduction control, without isolating intermediate-frequency noise and high-frequency noise. A frequency having an obvious effect on the sound experience of a person is mainly within a frequency range of 3 Hz to 50 Hz, a frequency ranging from 500 Hz to 2 kHz is an intermediate frequency (for example, the disaster/emergency response alarm signals and the whistle signals of a police car, an ambulance and a military vehicle are within a range of 650 Hz to 750 Hz), a high frequency ranges from 2 kHz to 26 kHz, and a frequency higher than 20 kHz is called ultrasonic wave. Therefore, by the open-ear and active noise cancelling control, while enjoying music without worrying about the interferences from the external noise, a user will remain vigilant about the surrounding environment, such as emergencies or calling for help.

The present application supports that basic sound channels of the digital sound stereo system are independently connected to different speakers, i.e., a front right speaker, a center speaker, a front left speaker, a rear right speaker and a rear left speaker, and also supports output by a single sound channel and stereo output. By equipping with an audio decoding chip 34 that fully supports two digital surround standards (i.e., Dolby and DTS), a high-performance Micro-Controller digital surround audio decoder for compounding and processing signals is realized, and the high-quality sound effect experience of the wearable personal sound products is satisfied. With the open noise cancellation, vibration control effects, efficient power control and structural optimization, users are able to enjoy the high-quality of sound without causing unnecessary interference to the surrounding environment. Users can also be aware of the conditions around the surrounding environment, thereby reducing the chances of accidents. By additionally incorporating mini vibration motors into the invention (a center vibration motor 14, a right center vibration motor 18, a front right vibration motor 23, a left center vibration motor 29 and a front left vibration motor 31), users can experience the high-quality sound effect and also enjoy the massage experience, particularly to the shoulders, the neck, and the surrounding muscles and acupuncture points. In the present application, by additionally providing telescopic structures (adjustment slide strips 3) and guide structures for the placement positions, angles and sound channel ports of the speakers (a center speaker 13, a right center speaker 17, a front right speaker 22, a left speaker 30 and a front left speaker 32), the individual requirements are satisfied; and different sound effect compensation circuits are designed additionally by the audio balancer. The present application can provide various alternative application methods: playing by a loudspeaker, playing by an earphone, access to AUX, NFC (Near Field Communication), Bluetooth transmission, Wi-Fi transmission or infrared transmission. The wearable stereophonic device can be cooperatively connected and used with other advanced application technologies such as Virtual Reality (VR), Augmented Reality (AR) and Mixed Reality (MR), and compatible to other applications and devices such as electronic sports, smart motorbikes or smart bikes, while backward compatible with the previous audio/video connection modes such as Auxiliary Input (AUX In).

Although the present application has been described in detail above, and the principles and implementations of the present invention have been illustrated herein by specific instances, the description of the embodiments is merely for facilitating the understanding of the method and core concept of the present application. Meanwhile, a person having ordinary skill in the art can make alterations to the specific implementations and the range of application according to the concept of the present application. In conclusion, the contents in the description shall not be regarded as any limitations to the present application.

What is claimed is:

1. A wearable stereophonic device, comprising:

a right shell, a center shell and a left shell, wherein two sides of the center shell are connected to the right shell and the left shell through adjustment slide strips (3), respectively;

the center shell comprises an adjustment position surface shell (1), an adjustment position bottom shell (2) and a center loudspeaker (8);

the right shell comprises a front right surface shell (4), a front right bottom shell (5), a right loudspeaker (9) and a first PCB board (16);

the left shell comprises a front left surface shell (6), a front left bottom shell (7), a left loudspeaker (10), a second PCB board (27) and a lithium battery (26); and the first PCB board (16) is arranged between the front right surface shell (4) and the front right bottom shell (5), and an earphone jack (19), a wireless communication chip (20) and a charge interface (24) are provided on the first PCB board (16).

2. The wearable stereophonic device according to claim 1, wherein:

the center loudspeaker (8) consists of a center speaker grille and a center speaker (13); a center vibration motor (14) and the center speaker (13) are arranged between the adjustment position surface shell (1) and the adjustment position bottom shell (2); the adjustment slide strips (3) are arranged on left and right sides of the center shell; and movable sliders (15) are provided at ends of the adjustment slide strips (3);

a right control bottom (11) and an LED lamp and lampshade (25) are provided on the front right surface shell (4); the right loudspeaker (9) consists of a right center speaker (17), a front right speaker (22) and a front right speaker vibration diaphragm (21); the front right speaker vibration diaphragm (21) is attached onto a surface of the front right speaker (22); a right center vibration motor (18) is provided besides the right center speaker (17); and a front right vibration motor (23) is provided besides the front right speaker (22); and the lithium battery (26) and the second PCB board (27) are arranged between the front left surface shell (6) and the front left bottom shell (7); a microphone (28), an audio decoding chip (34) and a microprocessor (35) are provided on the second PCB board (27); a left control button (12) is provided on the front left surface shell (6); the left loudspeaker (10) consists of a left center speaker (30), a front left speaker (32) and a front left speaker vibration diaphragm (33); the front left speaker vibration diaphragm (33) is attached onto a surface of the front left speaker (32); a front left vibration motor (31) is provided besides the front left speaker (32); and a left center vibration motor (29) is provided besides the left center speaker (30).

3. The wearable stereophonic device according to claim 2, wherein the audio decoding chip (34) is connected to the center speaker (13), the right center speaker (17), the earphone jack (19), the front right speaker (22), the left center speaker (30), the front left speaker (32) and the microprocessor (35), respectively; and, the microprocessor (35) is connected to the right control bottom (11), the left control button (12), the center vibration motor (14), the right center vibration motor (18), the wireless communication chip (20), the front right vibration motor (23), the microphone (28), the left center vibration motor (29) and the front left vibration motor (31), respectively.

4. The wearable stereophonic device according to claim 3, wherein the microphone (28) is used for receiving external noise; the microprocessor (35) is used for generating reversed-phase noise which is opposite in phase to the external noise, and superposing the reversed-phase noise into outputs from the center loudspeaker (8), the right loudspeaker (9) and the left loudspeaker (10).

5. The wearable stereophonic device according to claim 4, wherein the microphone (28) has a front low-pass filter which has a cutoff frequency of 200 Hz and is used for filtering sound at a frequency of above 200 Hz.

6. The wearable stereophonic device according to claim 1, wherein the wireless communication chip (20) can be one or more of a Bluetooth chip, a Near Field Communication (NFC) chip, a Wi-Fi chip and an infrared chip.

* * * * *